United States Patent [19]

Boynton et al.

[11] 4,099,046

[45] Jul. 4, 1978

[54] THERMAL PRINTING DEVICE

[75] Inventors: Robert James Boynton, Ottawa; Frederick Caldwell Livermore, Kanata, both of Canada

[73] Assignee: Northern Telecom Limited, Montreal, Canada

[21] Appl. No.: 786,445

[22] Filed: Apr. 11, 1977

[51] Int. Cl.[2] ..... H05B 1/00

[52] U.S. Cl. ..... 219/216; 219/543; 346/76 R

[58] Field of Search ..... 219/216, 543; 346/76 R; 29/611; 338/307-309; 427/102, 103, 123-126

[56] References Cited

U.S. PATENT DOCUMENTS 3,967,092 6/1976 Conta et al. ..... 219/216

*Primary Examiner*—C. L. Albritton

*Attorney, Agent, or Firm*—Sidney T. Jelly

[57] ABSTRACT

A thermal printing device comprises a continuous bar of electrically resistive material, with patterns of electrical conductors on each side of the bar. Connections are made to the bar from the conductor patterns at closely spaced positions. The conductor patterns are formed as columns on one side and rows on the other side to enable connections between columns and bar and rows and bar such that the number of external connections is minimized. The connections to the bar from the conductor patterns are staggered on one side of the bar relative to the other side. This doubles the center-to-center distance of such connections as correspond with connections which are opposite each other. This enables wider connection paths while still maintaining the original resolution.

12 Claims, 9 Drawing Figures

THERMAL PRINTING DEVICE

This invention relates to a thermal printing device, particularly but not essentially for facsimile printing.

Thermal printing devices in the form of a number of individual, discrete, heating elements, each of which is activated as required. The resolution available is limited by the minimum spacing which can be obtained. At present resolutions of the order of 0.02 inches are available. For high resolution, as for facsimile printing, resolutions, down to 0.005 inches are desirable. Such high resolution is desired when printing out drawings, pictures, small type and other items having fine detail, transmitted over telecommunications systems. Also, it is desirable to be able to transmit and print a full page width and the speed of printing should be at a reasonable level. As the paper used undergoes a colour change by heat it is necessary to generate sufficient heat, for a sufficient length of time, to produce the desired colour density of print.

It has been proposed in application Ser. No. 638,611 filed Dec. 8, 1975, in the name of the present assignee, that a continuous bar of electrically resistive material be used, with patterns of conductors on each side of the bar connected thereto, with a particular arrangement of forming the patterns, whereby on selective energization of patterns, heated areas are produced in the bar at desired positions.

While the arrangement described in the above-identified application is effective and provides high resolution with a satisfactory colour density, it is necessary for the conductors to the bar to be very narrow and closely spaced. For example, for a resolution of 200 dots per inch the centre to centre distance of the contacts is 0.005 inch and the conductor widths are of the order of 0.003 inch. This can give rise to difficulties in manufacture. Also, some of the conductors of the patterns are long and can have a resistance which can be intrusive in the overall system.

The present invention provides for an arrangement of the conductors in the conductor patterns which double the centre-to-centre spacing while retaining a particular resolution. Thus, an example, while providing a resolution of 200 dots to the inch, there is a 0.005 inch centre-to-centre spacing of the dots, the conductors to the bar can have a centre-to-centre spacing of 0.010 inch. This is obtained by staggering the conductors on one side of the bar relative to the conductors on the other side of the bar. By selective activation of a first conductor on one side it can be caused to be connected to one or the other of two conductors on the other side of the bar and positioned on either side of the centre line of the first conductor.

Other details of construction of the device will also be apparent from the following description of certain embodiments, by way of example, in conjunction with the accompanying drawings, in which.

Figure 1:
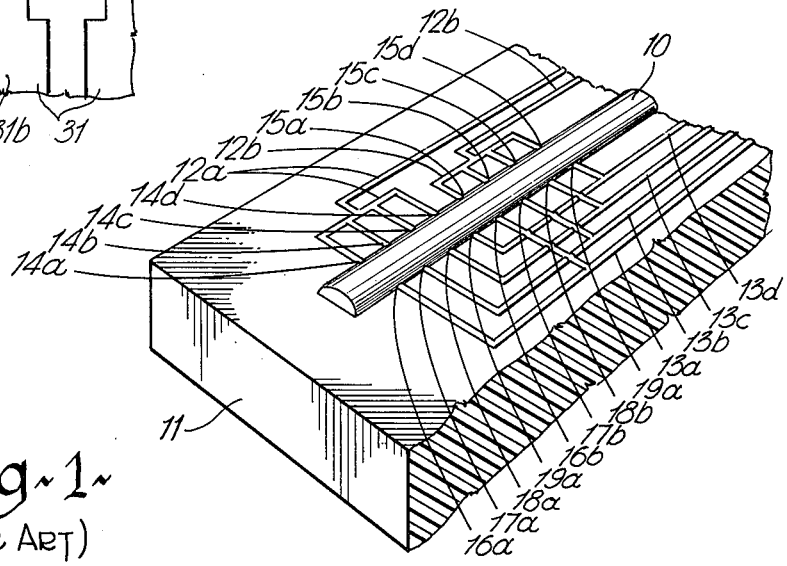
Fig. 1 (Prior Art)
FIGS. 1 and 2 are diagrammatic perspective views of a typical cross-section of a device as described in the above-mentioned application.
Figure 2:
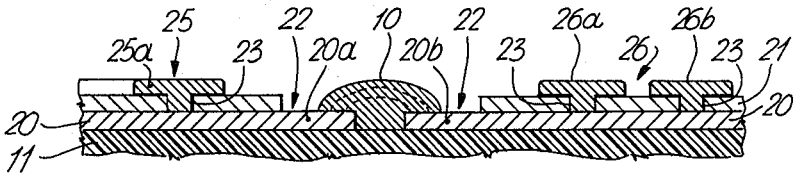
Fig. 2 (Prior Art)

FIGS. 1 and 2 illustrate the proposed concept in the aforementioned application, FIG. 1 being a diagrammatic view showing the print bar 10, a continuous bar of electrically resistive material, on a substrate 11, two conductor patterns 12*a* and 12*b* on one side of the bar 10 and four conductor patterns 13*a*, 13*b*, 13*c* and 13*d* on the other side of the bar 10. The two conductor patterns 12*a* and 12*b* each contact the bar 10 at a plurality of spaced apart positions 14*a* – 14*d* and 15*a* – 14*d* respectively. The conductor patterns 13*a*, 13*b*, 13*c* and 13*d* contact the bar 10 at interspersed spaced apart positions 16*a*, 16*b*, 17*a*, 17*b*, 18*a*, 18*b*, and 19*a*, 19*b* respectively. By suitably connecting a particular pattern 12*a* or 12*b*, and a particular pattern 13*a*, 13*b*, 13*c* or 13*d*, to an electrical power source, a hot spot can be formed in the bar 10 at one of the opposed contact positions. It will be noted that there must be a contact on one side of the bar for every contact on the other side of the bar. With desired centre-to-centre spacings of 0.005 inch, for 200 lines per inch resolution, the conductor patterns are quite narrow and closely packed.

FIG. 2 is a typical cross-section through the conductor patterns for an arrangement as in FIG. 1. The bar 10, for example, is of thick film form, deposited over the opposed ends of conductors 20, which are of thin film form. An insulating layer 21 is formed over the conductors 20 leaving gaps 22 on either side of the bar 10. Vias or interconnect holes 23 are formed at desired positions, and conductor patterns 25 and 26 formed over the insulating layer, the conductor patterns having individual conductors 25*a* (corresponding to conductor 12*a* in FIG. 1 for example) and 26*a* and 26*b* (corresponding to conductors 13*d* and 13*c* of FIG. 1). The conductors 25*a*, 26*a* and 26*b* contact their respective conductors 20 through the vias 23, and can be of thin film form or screened thick film.

As stated, the present invention enables the centre-to-centre distances of the conductors connecting to the bar to be doubled, thus enabling the width of the conductors to be increased substantially, while still providing the same resolution as in the arrangement of FIG. 1. This is obtained by staggering one set of connections to the bar relative to the other set of connections. This is illustrated diagrammatically in FIG. 3. For clarity, apart from the resistance bar, still identified as item 10, and the support or substrate 11, all other items have different references, relative to FIGS. 1 and 2.

Figure 3:
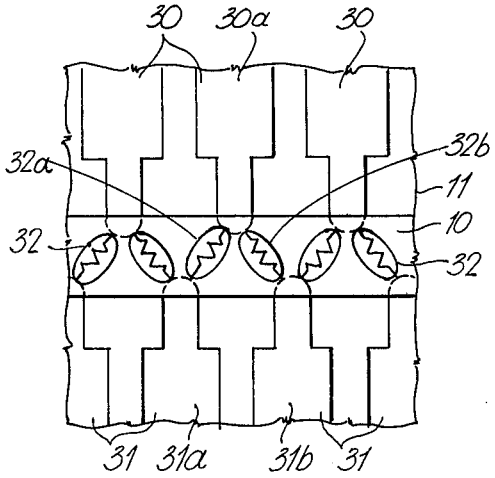
FIG. 3 is a diagrammatic plan view of a conductor/-bar arrangement in accordance with the present invention.

Thus, as seen in FIG. 3, conductors 30 are connected to one side of the bar 10 and conductors 31 are connected to the other side of the bar. The conductors 31 are staggered relative to conductors 30, the centre lines of conductors 31 being midway between the centre lines of conductors 30. Depending upon the power connections, a conductor 31 can be connected to one or the other of two conductors 30. Thus, in FIG. 3, if conductor 30*a* is connected to a power source and also conductor 31*a*, then a hot spot will be formed at 32*a*, while if conductors 30*a* and 31*b* are connected to a power source a hot spot will be formed at 32*b*. The position of hot spots are indicated generally at 32.

Figure 5:
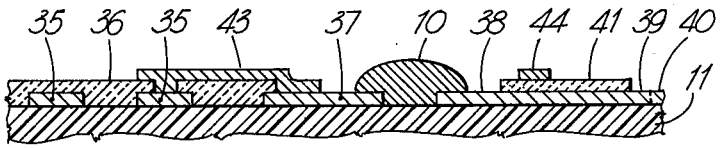
FIG. 5 is a cross-section on the line V—V of FIG. 4.
Figure 4:
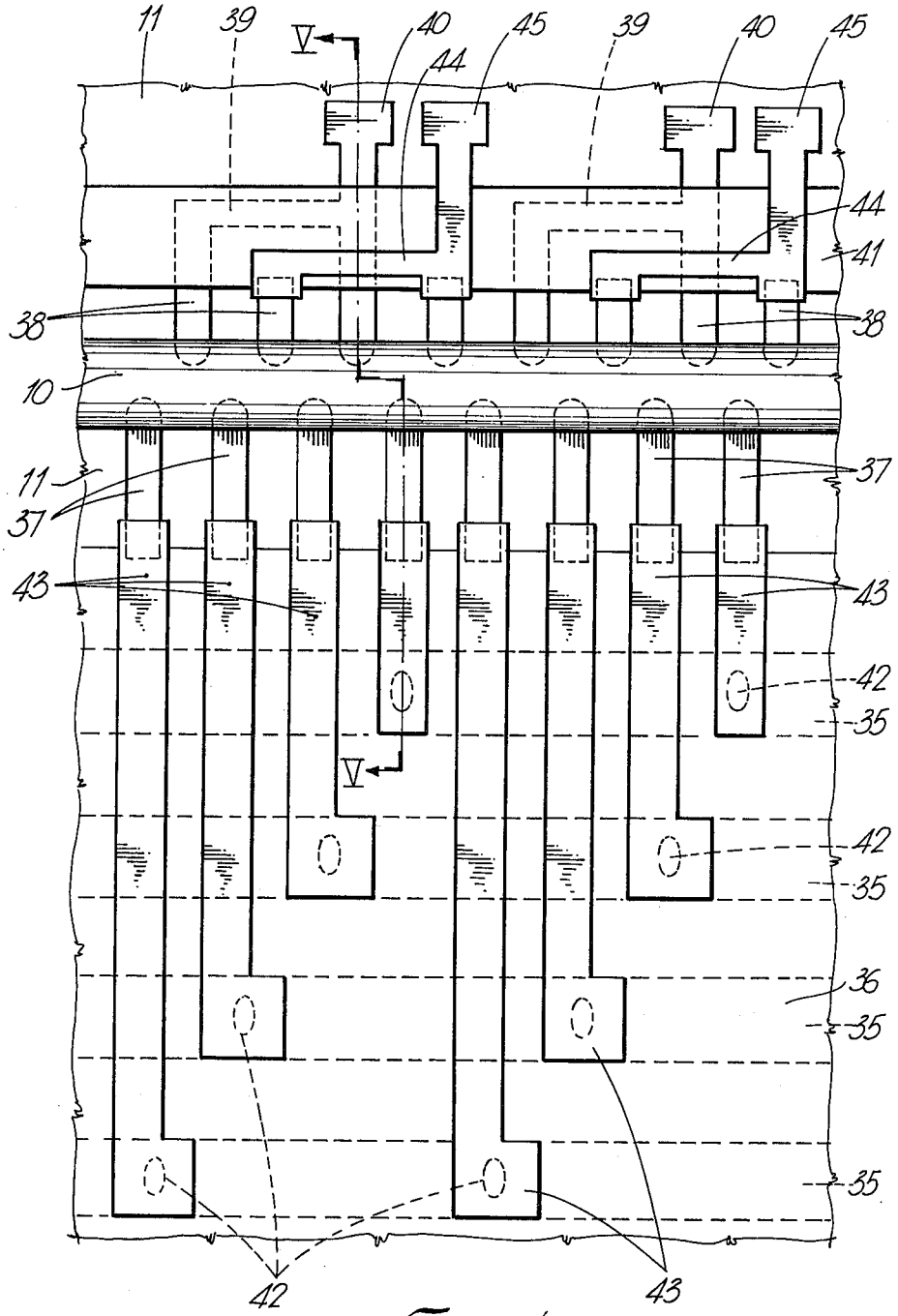
FIG. 4 is a diagrammatic plan view of conductor patterns on each side of the bar.

FIG. 4, in association with FIG. 5, illustrates in slightly more detail one form of conductor arrangement. On substrate 11 a plurality of transverse conductors 35 are formed on one side of the bar 10, the conductor 35 extending parallel to the bar. There is no physical limitation on the width and spacing of the conductors 35, except that the ultimate size of the finished device, in a direction normal to the axis of the bar 10, will depend upon the width and spacing and also the lengths of the connections from the conductors to the bar will be affected, as will be appreciated later with respect to FIG. 6. However, with these details in mind, it is possible to make the widths and spacing of the conductors 35 such that manufacturing problems will be minimal and a very high level of good quality manufacture attained. This is important as, after forming of the conductors 35, as by thick film, for example fritless gold, process, the conductors 35 are covered by an insulating glaze layer 36. Thereafter repair is at least, extremely difficult. Other ways of forming the conductors 35 can be used, such as etching back of thick or thin film materials. Various metallizations are available, apart from gold, for example palladium - silver thick film.

At the same time as the conductors 35 are formed on the one side of the bar 10, a plurality of primary connector portions 37 are formed on the substrate, the primary connector portions extending normal to the bar 10 and stopping short of the first conductor 35. These primary connector portions 37 can be formed of the same material as the conductors 35 in the one process step. Also formed at the same time, and conveniently of the same material, are conductor and connector patterns on the other side of the bar 10. These patterns are in two forms. Thus a plurality of connectors 38 are formed, extending normal to the axis of the bar 10, the connectors 38 positioned midway between the connector portions 37. Alternate connectors 38 are formed unitarily with conductors 39, the connectors 38, conductors 39 and terminal pads 40 formed at the same time. As insulating glaze layer 41 is then applied over the conductors 39 and part of each connector 38. Layer 41 is usually applied at the same time as layer 36 over conductors 35.

The bar 10 is not actually formed until at least after the connector portions 37 and 38 are formed. It is normally formed by a thick film process and may be of more than one layer.

In the layer 36, vias 42 are formed in a predetermined pattern. The vias 42 can be formed by laser machinery or by suitable screening in the thick film process for applying the glaze layer. Secondary connector portions 43 are then formed on the glaze layer 36. At one end, the end closest to the bar 10, each secondary connector overlaps the end of a primary connector portion 37 and is electrically connected thereto. At its other end, each secondary connector portion overlaps a particular conductor 35 and is electrically connected thereto through the related vias 42.

Also formed at the same time as the secondary connector portions 43, and of the same material, on the other side of the bar 10, are additional conductors 44. These conductors 44 overlap the alternate connectors 38 not unitary with the conductors 39. These alternate connectors 38 are formed shorter than the other connectors 38, as seen in FIG. 4, and extend only a short way under the glaze layer 41. The conductors 44 have terminal pads 45.

Terminal pads, not shown in FIG. 4, are provided at one end of each conductor 35. For convenience, and to permit large pads, these may be formed at alternate ends, as will be seen in FIG. 6. The particular relative widths of conductors and connectors, in FIG. 4, is illustrative only and can be varied. Thus, for example, some or all of the secondary connector portions 43 can be made wider than the primary connector portions 37. It is also conceivable that the primary and secondary connector portions 37 and 43 could be formed at one time, the bar 10 being formed after forming the connectors. This would particularly be the case if thin film resistive elements are used.

Figure 6:
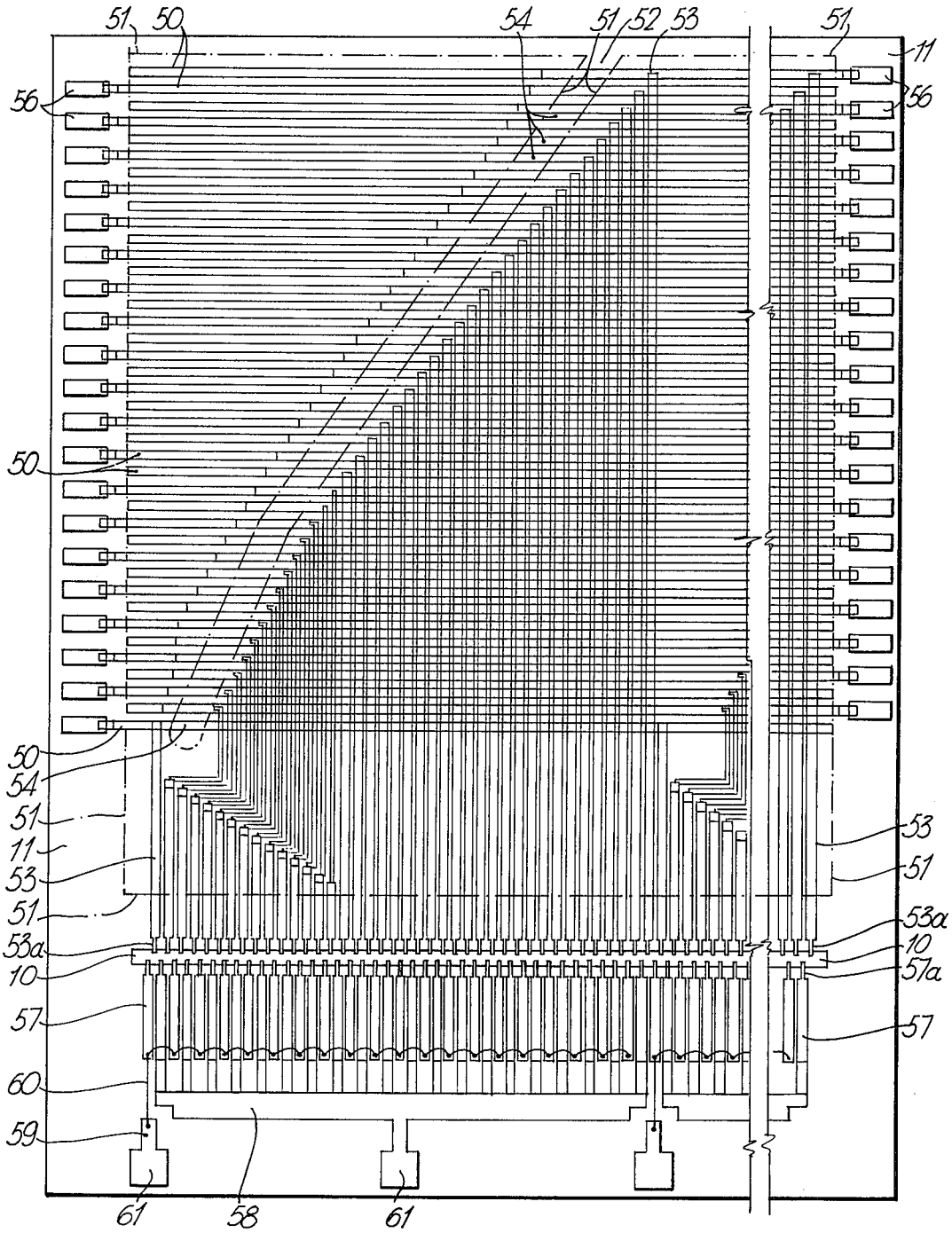
FIG. 6 is a plan view of a section of conductor patterns and resistor bar, for a facsimile printer.

FIG. 6 illustrates one section of a device, with an arrangement of conductors and connectors to provide a wide, easy to manufacture contact area between conductors and connectors. A pattern of conductors 50 is formed on substrate 11 extending parallel to each other and to the bar 10. These conductors 50 correspond to the conductors 35 of FIG. 4. Over the conductors 50 is formed an insulating glaze layer, the periphery of which is indicated by the chain-dotted line 51. A trough or channel 52 is formed in the glaze layer, which leaves exposed a short length of each conductor 50. On the glaze layer is formed a pattern of connectors 53 which extend at one end to the bar 10 via short conductive connectors 53*a* — which correspond to the connector portions 37 of FIG. 4. Each connector 53 extends to a unique conductor 50. The shorter connectors, that is the left-hand part of the section in FIG. 6 except for the first connector are of narrower configuration and follow a cranked or bent path to provide room for the channel 52. The connections having longer paths are straight and also wider. This enables the resistance of the longer connector paths to be kept to a desirable low value. Then a further short transverse conductive extension to each connector is formed, overlying a related conductor and making electrical contact with the conductor in the channel 52. These transverse extensions are indicated at 54. A short transverse extension 54 is also formed for the first, or most left-hand, connector.

There is an advantage in this construction that the more closely spaced connectors 53 are on top of the glaze layer and can be repaired quite easily. The connectors can be of thin film structure.

The conductors 50 terminate at alternate ends in terminal pads 56 which can be formed at the same time as the conductors or at a separate stage in the manufacture. By forming the pads 56 at alternate ends, large pads can be provided. However, the pads 56 can all be at the same end and it is possible to provide two columns of pads, the connectors alternating, with alternate conductors extending between the pads of the innermost column.

A second pattern of conductors and connectors is formed on the substrate on the remote side of the bar relative to the conductors 50. As seen in FIG. 6, a plurality of connectors 57 extend from the bar 10, the centres of the connectors 57 midway between the centres of the connectors 53. Alternate connectors 57 extend to a transverse conductor 58 and are connected to the bar 10 by connectors 57*a*. The remaining connectors are then connected to a short conductor 59. This is shown diagrammatically in FIG. 6 by the line 60.

Figure 7:
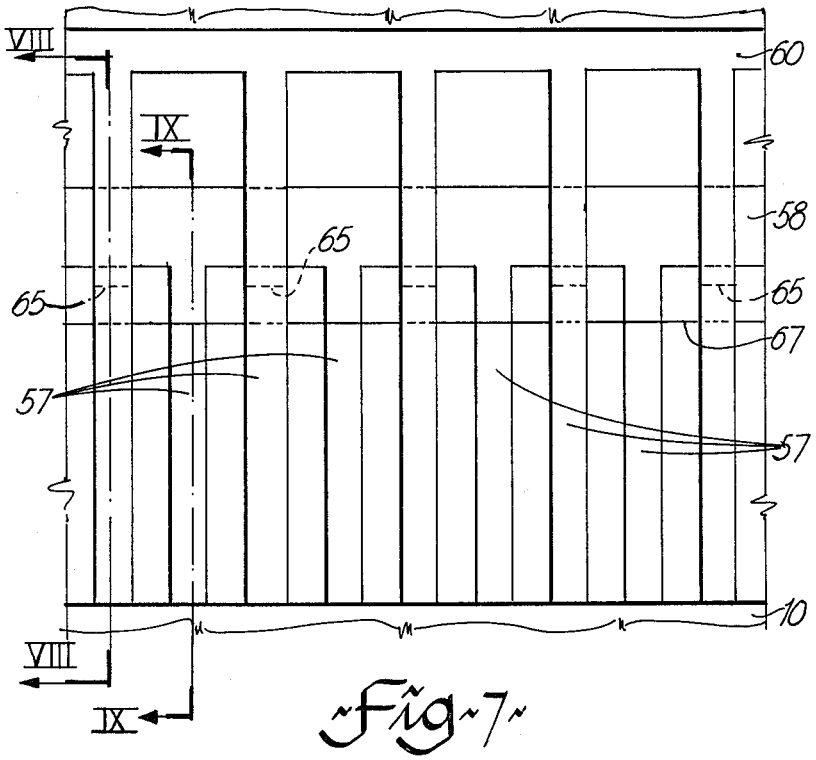
FIG. 7 is a diagrammatic plan view of one form of connector and conductor patterns for the arrangement of FIG. 6.
Figure 8:
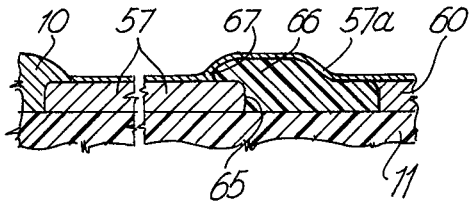
FIG. 8 is a cross-section on the line VIII—VIII of FIG. 7.
Figure 9:
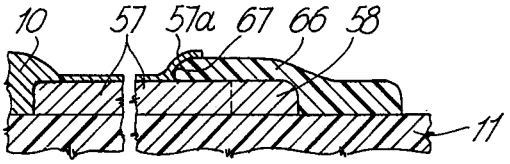
FIG. 9 is a cross-section on the line IX—IX of FIG. 7.

FIGS. 7, 8 and 9 illustrate one way of connecting the connectors 57 alternately to transverse conductors 58 and 60. On the substrate 11 is formed the bar 10. The bar 10 overlies the inner ends of the connectors 57. Alternate connectors continue to, and can be integral, and formed at the same time, with the transverse conductor 58. The other connectors finish short of the transverse conductor 58, as indicated by dotted lines 65. A dielectric glaze 66 is then formed over the transverse conductor 58, the glaze extending to the line 67. The transverse conductor 60 is formed and at the same time conductors designated 57*a* in FIGS. 8 and 9, are formed on the connectors 57. The thin film gold layer extends substantially from the bar 10, over thick film gold connectors 57, over the glaze and into contact with conductor 60, as seen in FIG. 7. For the connectors connected to the conductor 58, the thin film layer 57*a* extends substantially from the bar 10, along part of each connector 57 and the up and over the glaze 66 for a short distance, as seen in FIG. 8. Conductors 57*a* can be formed separately from conductor 60, if desired.

The glaze layer 66 assists in ensuring that there is lifting of the ends of the connectors 57. The thin film gold layers 57*a* provide connection between the connectors 57 and the transverse conductor 60 and also improve the physical structure of the connectors 57. Thick film layers, as used for the connectors 57, can often have pin holes therein, and the thin film closes such pinholes and improves the conductivity of the connectors 57.

The section illustrated in FIG. 6 has forty connectors 57, and forty connectors 53. By selective connection of terminal pads 56 and 61 this provides eighty possible hot spots in the bar 10 for that section. For a 200 line per inch resolution, hot spots must be formed at 0.005 inch centres. However, with the constructional arrangement described above, and illustrated in FIGS. 3, 4 and 5, and FIG. 6, centre-to-centre distances for the connectors are 0.010 inch. This enables wider conductors and wider gaps to be used, for at least a large part of each section, with increased processing efficiency and higher yield. The number of connectors is halved, forty instead of eighty for a section as described.

A protective layer can be applied over the connectors 53 and 57.

The various layers for the bar 10, conductors 35, 39 and 44, and connectors 37, 38 and 43, in FIGS. 4 and 5, conductors 50, 58 and 59 and interconnection 60 and connectors 53 and 57 of FIG. 6, are formed by well known conventional processes, and can be of thin film, thick film or other form as desired.

What is claimed is:

1. A thermal printing device comprising:

a substrate of electrically insulating material;

a continuous bar of electrically resistive material on a surface of said substrate;

a first pattern of electrical conductors on said surface of said substrate and extending along one side of said bar and first electrical connectors extending from said first pattern to said bar, said first electrical connectors connected to said bar at said one side in a closely spaced predetermined arrangement extending along the bar, said first pattern of electrical conductors comprising first and second series of conductors, said second series overlying said first series, a dielectric layer interposed between said two series, and forming a plurality of columns, each column electrically separate from other columns, and a plurality of said first electrical connectors extending side-by-side from each of said columns to said bar of electrically resistive material said first electrical connections connected alternately to said first and second series of conductors;

a second pattern of electrical conductors on said surface of said substrate and extending along the other side of said bar, and second electrical connectors from said second pattern to said bar, said second electrical connectors connected to said bar at said other side in a closely spaced predetermined arrangement extending along the bar, said second electrical connectors connected to said bar at positions intermediate the positions at which said first electrical connectors are connected to said bar, said second pattern of electrical conductors comprising a plurality of rows, each row electrically separate from other rows, and a plurality of said second electrical connectors extending from each of said rows to said bar, each electrical connector from a row connected to said bar opposite a first electrical connector connected to a single different one of said columns, each row connected by said second electrical connectors to said bar at positions different from each other row;

means for connecting an electrical power supply to said patterns of electrical conductors to apply electric current to selected electrical connectors on each side of said bar to produce heated areas in said bar.

2. A thermal printing device as claimed in claim 1, said continuous bar comprising at least one thick film deposited layer.

3. A thermal printing device as claimed in claim 1, said continuous bar comprising a plurality of superposed layers.

4. A thermal printing device as claimed in claim 1, said first and second patterns of electrical conductors each comprising a thin film layer.

5. A thermal printing device as claimed in claim 1, said first and second patterns of electrical conductors each comprising a thick film layer.

6. A thermal printing device as claimed in claim 1, said first and second electrical connectors each comprising a thin film layer.

7. A thermal printing device as claimed in claim 1, said first and second electrical connectors each comprising a thick film layer.

8. A thermal printing device as claimed in claim 1, said first connectors connected to said bar at a centre to centre dimension of the order of 0.010 inch, the second connectors connected to said bar at positions substantially equi-distant to the positions at which said first connectors are connected to said bar.

9. A method of producing a thermal printing device, comprising:

forming a first layer of electrically conductive material on a surface of an electrically insulating substrate, on one side of an axis extending across said substrate, said first layer defined to form a plurality of first electrical connectors extending normal to said axis in closely spaced parallel array and having ends adjacent to said axis, and defined to form a first series of electrical conductors, each of said first series of electrical conductors connected to a predetermined number of alternate first electrical connectors;

forming an electrically insulating layer over said first connectors and said first series of first electrical conductors, said second electrically insulating layer defined to have said ends of said first electrical connectors exposed;

forming a second layer of electrically conducting material on said electrically insulating layer, said second layer defined to form a second series of said first electrical conductors, said second series of first electrical conductors connected to those electrical connectors extending between the first electrical connectors connected to said first series of electrical conductors;

said first electrical connectors and said first and second series of first electrical conductors forming a first electrical pattern on said surface of said substrate on said one side of said axis;

forming a second electrical conductor pattern on said surface of said substrate, on the other side of said axis, said second conductor pattern including a plurality of second electrical connectors extending normal to said axis in closely spaced parallel array and a plurality of second conductors electrically separated from each other and defining a plurality of rows, each second conductor connected with a separate predetermined number of second connectors, the first connector of the first conductor pattern having ends positioned intermediate of the ends of the second connectors of the second conductor pattern;

said second electrical conductor pattern formed by forming a layer of electrically conductive material on said surface and defining said layer to form said plurality of second electrical conductors, forming an electrically insulating layer over said second connectors, said insulating layer defined to have said ends of said second connectors exposed, forming openings through said insulating layer, said openings formed in a predetermined pattern for a predetermined electrical connection pattern, forming a second layer of electrically conductive material on said insulating layer, said second conductive layer defined to form said second electrical connectors each said second electrical connector electrically connected to a predetermined number of second connectors via said openings in said insulating layer; and forming a continuous bar of electrically resistive material along said axis, said bar overlying said opposed ends of said connectors.

10. A method as claimed in claim 9, said second electrical connectors comprising primary portions and secondary portions, including forming said primary portions of said second electrical connectors, said second electrical conductors, said first electrical connectors and said first series of said first electrical conductors by said first layer of electrically conductive material.

11. A method as claimed in claim 10, including forming said secondary portions of said second electrical connectors and said second series of said first electrical conductors by said second layer of electrically conductive material, said secondary portions of said second electrical connectors interconnecting the respective primary portions and said second electrical conductors.

12. A method as claimed in claim 9, including forming connection pads at alternate ends of said second electrical conductors.

* * * * *